US010487444B2

(12) United States Patent
Sponable et al.

(10) Patent No.: US 10,487,444 B2
(45) Date of Patent: Nov. 26, 2019

(54) SPREADER-FEEDER

(71) Applicant: G.A. Braun, Inc., North Syracuse, NY (US)

(72) Inventors: Darren Sponable, Cicero, NY (US); Sean Miller, Kirkville, NY (US); Maxwell Krause, Liverpool, NY (US); Rachelle Radi, Baldwinsville, NY (US)

(73) Assignee: G.A. Braun, Inc., North Syracuse, NY (US)

( * ) Notice: Subject to any disclaimer, the term of this patent is extended or adjusted under 35 U.S.C. 154(b) by 132 days.

(21) Appl. No.: 15/917,107

(22) Filed: Mar. 9, 2018

(65) Prior Publication Data

US 2019/0276979 A1 Sep. 12, 2019

(51) Int. Cl.
*D06F 67/04* (2006.01)
*D06F 71/38* (2006.01)

(52) U.S. Cl.
CPC ..... *D06F 67/04* (2013.01); *D06F 71/38* (2013.01)

(58) Field of Classification Search
CPC ..... D06F 67/00; D06F 67/04; D06F 67/06; D06F 67/08; D06F 67/10; D06F 71/32; D06F 71/38
See application file for complete search history.

(56) References Cited

U.S. PATENT DOCUMENTS 3,421,756 A * 1/1969 Weir ..... D06F 67/04 38/143
3,772,808 A * 11/1973 Behn ..... D06F 67/04 38/143
4,378,645 A * 4/1983 Allen ..... D06F 67/04 38/8
4,774,505 A * 9/1988 Ueda ..... B61B 10/025 198/464.3
4,885,853 A * 12/1989 McCabe ..... D06F 67/04 38/143
5,440,810 A * 8/1995 Borucki ..... D06F 67/04 38/143
8,845,259 B2 * 9/2014 Nielsen ..... D06F 67/04 414/13
9,187,253 B2 * 11/2015 Olivieri ..... D06F 67/04

* cited by examiner

*Primary Examiner* — Ismael Izaguirre
(74) *Attorney, Agent, or Firm* — Bond Schoeneck & King, PLLC; George McGuire; Jonathan Gray

(57) ABSTRACT

A textile spreader apparatus, comprising: a first spread carriage and a second spread carriage, each configured to respectively receive opposing corners of a leading edge of a textile and to respectively convey the opposing corners in substantially opposing directions toward an extended position, such that the leading edge of the textile travels along a predetermined path; a catch arranged in the predetermined path of the leading edge, such that the catch intercepts the leading edge; and a sensor configured to detect when the catch intercepts the leading edge, wherein the catch is configured to retract from the path of the leading edge upon the sensor detecting a pressure applied to the leading edge, exceeding a threshold, wherein the threshold is reduced as the first spread carriage and the second spread carriage convey the opposing corners toward the extended position.

20 Claims, 8 Drawing Sheets

SPREADER-FEEDER

BACKGROUND

Industrial laundry applications require the processing of large numbers of flatwork textile articles. At various points in the process, the textile articles are washed and dried before they are laid flat and ironed. The steps of laying the articles flat and feeding them to be ironed are accomplished by a spreader/feeder. Spreader/feeders operate by receiving the corners of one edge of a textile article, spreading those corners apart so that the edge of the textile is pulled flat, and laying the textile on a roller or conveyer (also referred to as a feed table) to feed the textile to a downstream ironer.

Because a given spreader/feeder may receive textile articles of different sizes, each spreader/feeder must be able to spread the received textile article the appropriate length. If the opposing corners of a textile are not spread far enough apart, the textile will not lay flat on the feeder. If the opposing corners are spread too far, unnecessary stress is placed on the textile.

The differing natures of the textiles being spread presents a particular problem for the spreader/feeder. Indeed, each textile received by the spreader/feeder will have unique characteristics that affect the size of the textile and, thus, the spreading process. One reason for the variety of sizes between different textiles is moisture retention. Many items, when processed at the spreader/feeder, are wet—often with 30-40% moisture retention—whereas other items are completely dry. Two textiles from the same manufacturer, or even the same production lot, may be unequal in size due to their moisture retention. Furthermore, different textiles have often undergone differing numbers of laundered cycles, have differing exposure to use, abuse, and mending or repair, and are fed to the spreader/feeder in different ways. Not to mention that different textiles are made from a wide scope of materials including T120-600TC, 100% cotton, 60/40 cotton/poly blend, or poly-spun filament, each of which may be sourced from different manufacturers and countries with differing quality control standards. The net result is that the spread force applied to one textile may be sufficient to pull the textile flat, while the same force applied to another textile—having been processed more times, having different moisture retention, or made from a different material—will cause the textile to rip.

Accordingly, there exists a need in the art for detecting the length of a given textile to ensure that the textile is smoothly transferred from the spread mechanism to the feed table without improperly stretching the textile.

SUMMARY

This disclosure is generally related to an apparatus and method for detecting the length of a received textile's leading edge and using that length to spread the textile substantially flat without improperly stretching the textile. According to an aspect, a textile spreader apparatus, comprises a first spread carriage and a second spread carriage, each configured to respectively receive opposing corners of a leading edge of a textile and to respectively convey the opposing corners in substantially opposing directions toward an extended position, such that the leading edge of the textile travels along a predetermined path; a catch arranged in the predetermined path of the leading edge, such that the catch intercepts the leading edge; and a sensor configured to detect when the catch intercepts the leading edge, wherein the catch is configured to retract from the path of the leading edge upon the sensor detecting a pressure applied to the leading edge, exceeding a threshold, wherein the threshold is reduced as the first spread carriage and the second spread carriage convey the opposing corners toward the extended position.

In another aspect, a textile spreader apparatus comprises a first spread carriage and a second spread carriage, each configured to respectively receive opposing corners of a leading edge of a textile and to respectively convey the opposing corners in substantially opposing directions, such that the leading edge of the textile travels along a predetermined path; a catch arranged in the predetermined path of the leading edge such that the catch intercepts the leading edge; a sensor configured to detect when the catch intercepts the leading edge; and a controller configured to determine, once the catch intercepts the leading edge, based on the position of at least one of the first spread carriage or the second spread carriage, an extended position, wherein the first and second spread carriages, when respectively positioned at the extended position, are spaced apart substantially the length of the leading edge.

In another aspect, a method for determining the length of a leading edge of a textile, comprises the steps of: providing a textile spreader apparatus comprising a first spread carriage and a second spread carriage, each configured to move between an initial position and an extended position; grasping a pair of opposing corners of a leading edge of a textile with the first and second spread carriages, wherein each of the first and second spread carriages respectively grasps one of the opposing corners such that a portion of a leading edge of the textile is held slack about a catch; conveying, with the first spread carriage and second spread carriage, the opposing corners in substantially opposing directions such that the leading edge travels along a predetermined path such that the catch, arranged in the predetermined path, intercepts the leading edge; detecting, with a sensor, when the catch intercepts the leading edge; and determining, once the catch intercepts the leading edge, based on the position of at least one of the first spread carriage or the second spread carriage, an extended position, wherein the first and second spread carriages, when respectively positioned at the extended position, are spaced apart substantially the length of the leading edge.

DETAILED DESCRIPTION

Figure 1:
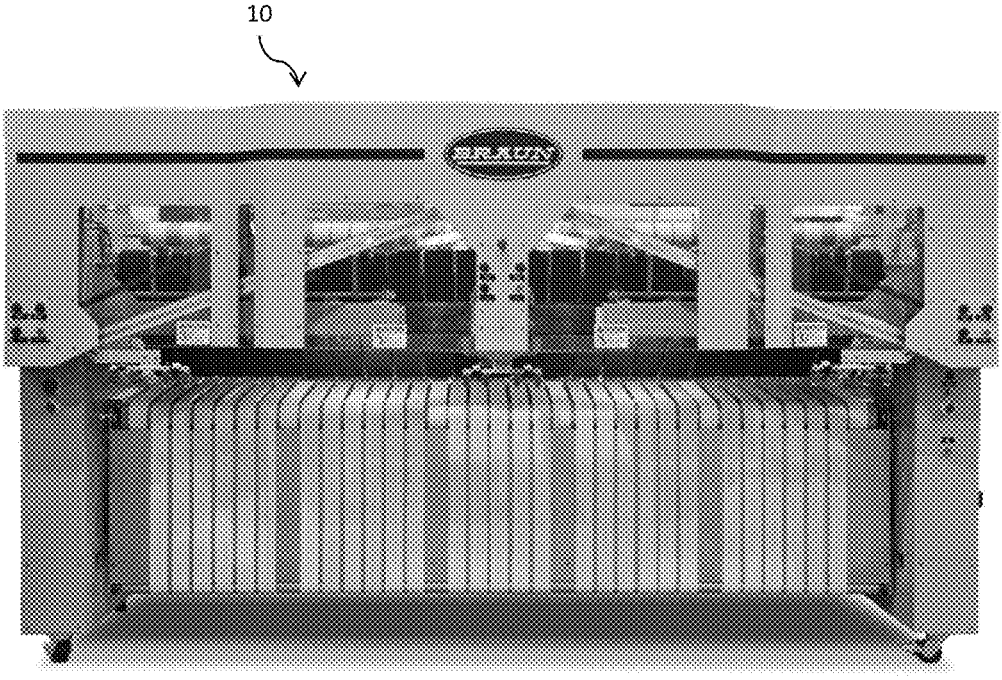
FIG. 1 is a front view of a spread/feeder according to an embodiment.
Figure 2:
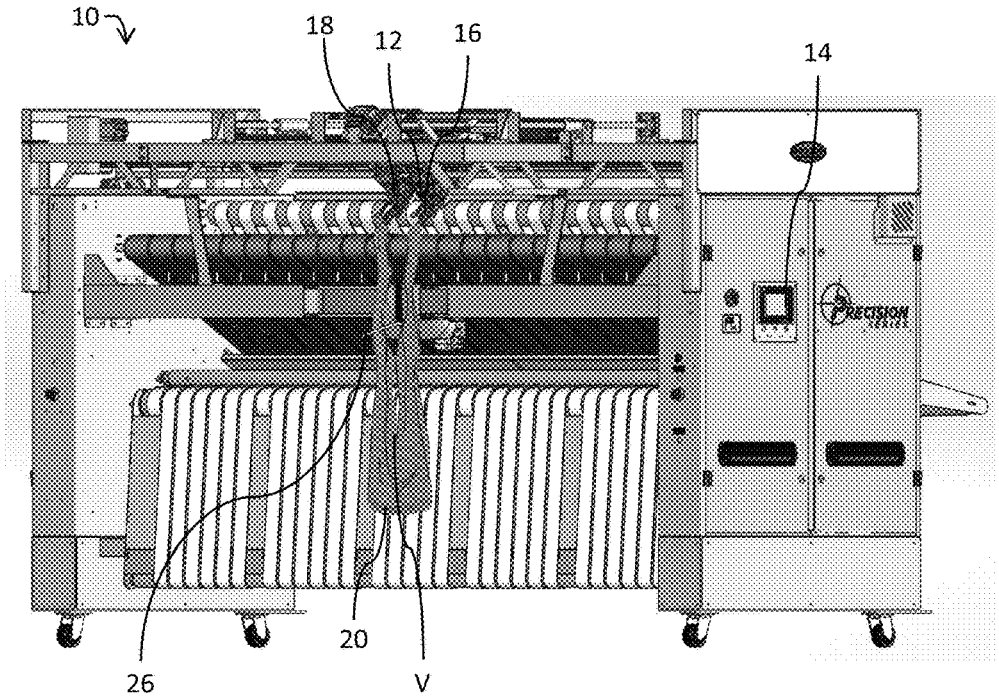
FIG. 2 is a front view of a spreader/feeder at the start of the spread sequence according to an embodiment.

Referring to the figures, a front view of a spreader/feeder 10 is shown in FIG. 1. As shown in FIG. 2 spread/feeder 10 comprises a textile spreader apparatus 12. FIG. 2 depicts the spreader/feeder 10 at the start of a spread sequence according to an embodiment. The textile spreader apparatus 12 comprises a spread mechanism, which comprises at least two spread carriages 16, 18 for receiving a textile 20 and pulling it flat.

Each spread carriage 16, 18 may be configured to move in substantially opposing directions between an initial position and an extended position. In the initial position, the spread carriages 16, 18 may be disposed adjacent one another, while in the extended position the spread carriages may be spread apart. Stated differently, in the initial position, the spread carriages 16, 18 will be a first length apart and in the extended position the spread carriages 16, 18 will be a second length apart, the second length being greater than the first length. As used in this disclosure, the initial position may be a reference point, used by at least one calculation, to calculate the length of the leading edge of textile 20. The initial point may, for example, be the point at which the spread carriages 16, 18 receive the opposing corners of the leading edge of textile 20. The extended position is the point at which the leading edge of the textile is fully extended—i.e., the spread carriages are spread apart substantially the length of the leading edge, such that the textile hangs from the spread carriages in a substantially flat matter to permit textile 20 to transition flatly to the feed table. It should be understood that, because any given textile 20 received by spreader/feeder 10 may have a different or uniquely sized leading edge, the extended position will vary for a given textile 20. Spreader/feeder 10 is thus configured to determine the location of extended position for a given received textile 20, using either a calculation or a look-up table, as will be described below.

The spreader/feeder 10 may include a controller 14 configured to perform the various tasks described in this disclosure. For example, the controller 14 may be configured to control the motion of the spread carriages 16, 18, to track or receive the location of spread carriages 16, 18, to monitor and/or control the pressure sensor 38 (FIGS. 7-8), to calculate the partial length of the leading edge, the length of the leading edge, and/or the location of the extended position. The controller may comprise an integrated circuit—such as a programmable logic controller (PLC), an application-specific integrated circuit (ASIC), or a field-programmable gate array (FPGA)—or a combination of integrated circuits working separately or in concert to complete the above tasks. Alternately, controller 14 may comprise one or more discrete circuits, either alone or in concert with one or more integrated circuits, configured to accomplish the tasks described in this disclosure. Indeed, one of ordinary skill in the art, in conjunction with a review of this disclosure, will appreciate that the controller may take any number of forms suitable for accomplishing the tasks described in this disclosure.

Figure 3:
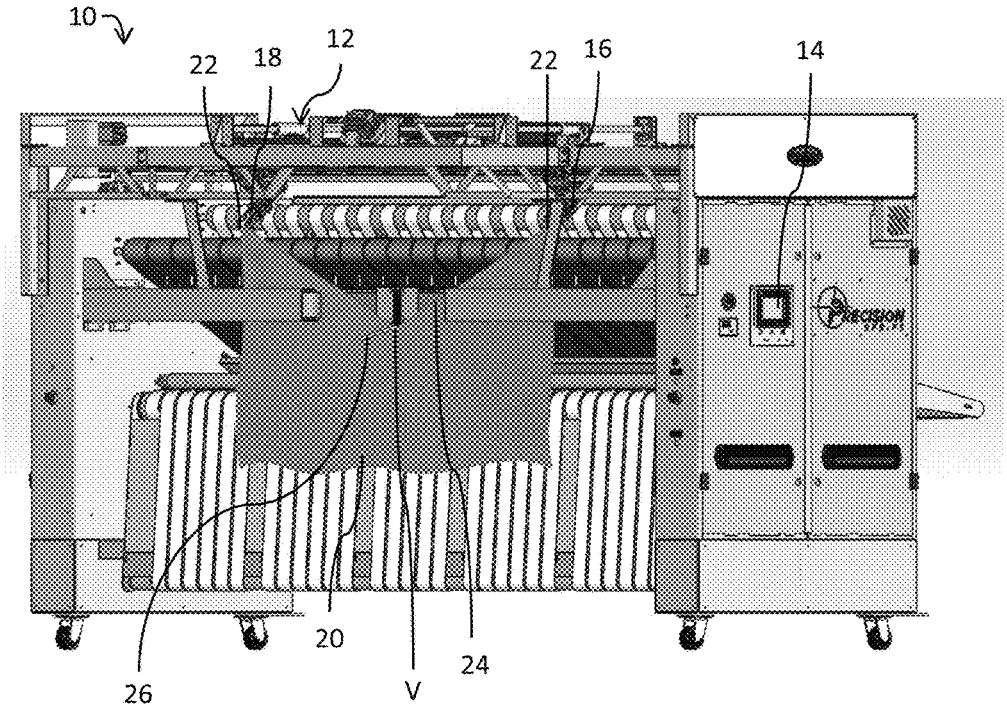
FIG. 3 is a front view of a spreader/feeder during the spread sequence according to an embodiment.

In one embodiment, spread carriages 16, 18 may each be conducted along a track by a servo (electric or pneumatic) or any other type of actuator suitable for conducting each spread carriage 16, 18 along the track, as shown in FIG. 3. In alternate embodiments, the spread carriages 16, 18 need not be conducted along a track—indeed, any structure suitable for carrying spread carriages 16, 18 from the initial position to the extended position, such as, for example, by a mechanical arm pivotally mounted to the textile spreader apparatus 12, may be used.

As mentioned above, spread carriages 16, 18 are conducted in substantially opposing directions. Here, "substantially opposing directions" means that the spread carriages 16, 18 move apart from each other in at least one dimension, such that the leading edge 24 of textile 20 is spread flat. Indeed, in addition to moving apart from each other in one dimension, spread carriages 16, 18 may move in any other dimension as long as the final position of leading edge 24 is substantially flat. For example, in addition to moving outward, both spread carriages 16, 18 may move upward. Of course, the directions that spread carriages 16, 18 move may have some effect on the methods of calculating the extended position and thus must be factored into the equations or look-up tables described below, as necessary.

Again, the spread carriages 16, 18 are configured to pull the leading edge of textile 20 flat. "Textile article" or "textile," as used in this disclosure may refer to any textile flatwork article, such as, but not limited to, bed sheets or tablecloths. Further, while rectangular textile articles are depicted in the figures, it should be understood that the method described may be used to determine the length of any leading edge 24 of a textile, regardless of the number of sides the textile includes.

Further, as used in this disclosure, "substantially flat" requires only that the leading edge be flat enough that the textile 20 may be transferred to the feed table in a manner suitable to be processed by the remaining downstream devices/workers, e.g., an ironer. The leading edge may be "substantially flat" and still follow a gentle arc. Further, when the spread carriages are in the extended position, and thus are positioned substantially the length of the leading edge 24, it should be understood that this length does not include the portion of the leading edge grasped by the spread carriages 16, 18 (e.g., the opposing corners of the leading edge).

Referring again to FIG. 2, the spread sequence will now be described. Before the spread sequence begins, each spread carriage 16, 18 may be configured to receive a corner portion 22 of a leading edge 24 of a textile 20. For example, each spread carriage 16, 18 may include a structure such as a hook, clip, or a clamp configured to grip corner portions 22 of the textile 20. While in the initial position, at the beginning of the spread sequence as shown in FIG. 2, the location of the spread carriages 16, 18 are such that the textile 20 is held slack, and leading edge 24 assumes a substantially parabolic shape (for the purpose of this disclosure, substantially parabolic means U-shaped—the leading edge 24 need not satisfy the mathematical definition of a parabola). In this way, the lowest part of the leading edge 24 of the textile 20 may form a vertex V of the substantially parabolic shape, the vertex V usually being at the center point of the leading edge 24 between the corner portions 22.

Figure 4:
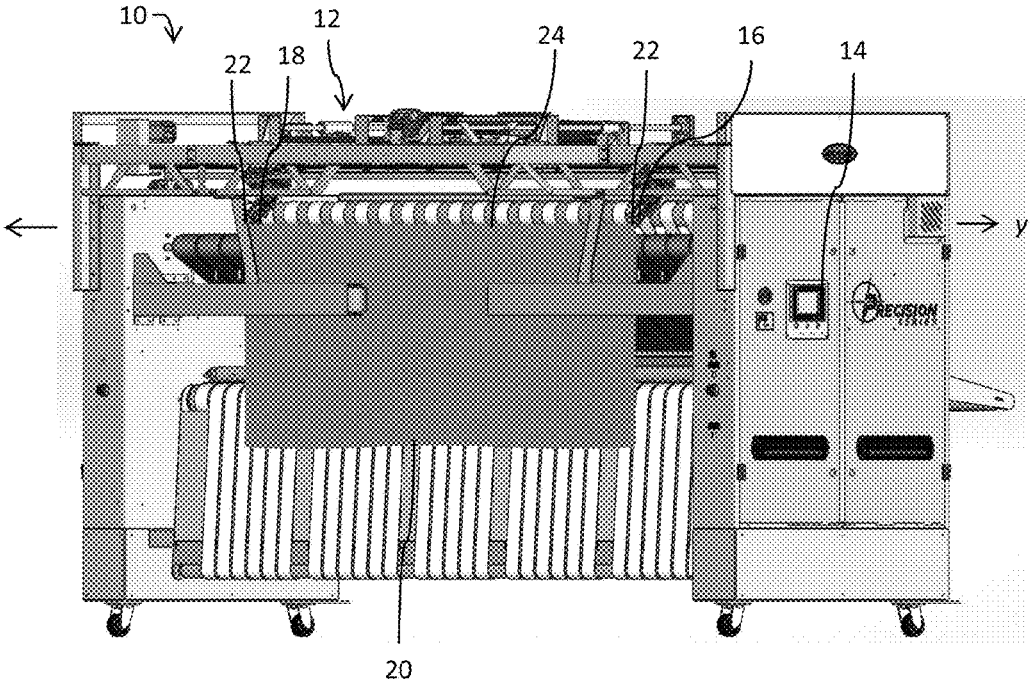
FIG. 4 is a front view of a spreader/feeder at the end of the spread sequence according to an embodiment.

A catch 26 may be arranged between and/or below (with respect to the surface upon which device 12 rests) spread carriages 16, 18 and positioned so that catch 26 is arranged within the substantially parabolic shape formed by leading edge 24. As the spread carriages 16, 18 move in substantially opposing directions, the leading edge 24 of the textile 20 will travel along a predetermined path until it is held in a substantially flat position, as shown in FIG. 4. The leading edge, placed within the substantially parabolic shape formed by leading edge 24, is thus arranged within the predetermined path of leading edge 24.

Because of the placement of catch 26, leading edge 24 will be intercepted by the catch 26 as a result of the spread sequence, as shown in FIG. 3. Once the leading edge is intercepted by catch 26, the location of at least one of the spread carriages may be measured/recorded, in order to calculate the location of the extended position using an equation or a look-up table. The length of leading edge may then be determined according to the known relative locations of catch 26 and at least one of spread carriages 16, 18. Thus, the respective positions of the catch 26 and at least one of spread carriages 16, 18 provide a set of knowns by which the length of the leading edge 24, and consequently the location of the extended position, may be determined. In this way, the respective locations of at least one spread carriage 16, 18, form the basis for the calculations and/or look-up table, used to determine the length of the leading edge 24, as described below.

The interception of the leading edge 24 by the catch 26 may be detected by one or more sensors. For example, the interception of leading edge 24 may be detected by a pressure sensor 38 (shown, for example, in FIGS. 7-8) operatively connected to catch 26 and configured to detect a pressure above a predetermined threshold applied by the leading edge 24 to catch 26. Alternately, one or more pressure sensors 38 may be operatively connected to spread carriages 16, 18 and configured to detect pressure above a predetermined threshold created by tension along the leading edge 24 as a result of pulling the leading edge 24 outward after it has been intercepted by catch 26. In yet another embodiment, a different type of sensor, such as a proximity sensor or optical sensor, may be employed to detect when the leading edge 24 contacts the catch 26 or extends past a predetermined point, to otherwise determine when the leading edge 24 has been intercepted by the catch 26.

Intercepting the leading edge 24 may include the step of pulling the leading edge into at least one flat length about the catch 26, forming, for example, a V-shape about vertex V, as shown in FIG. 3. Pulling the leading edge 24 into at least one flat length may be accomplished by setting the predetermined pressure threshold of the pressure sensor 38 to a point above zero, calculated to allow the motion of at least one spread carriages 16, 18 to advance beyond the point of initial contact with the leading edge 24 and pull the leading edge 24 about the catch 26 without stretching the textile 20 (described in detail below). Once the predetermined pressure has been realized by the motion of at least one of the spread carriages 16, 18, the location of at least one of the spread carriages may be measured and recorded, in order to calculate the location of the extended position using an equation or a look-up table.

It is conceivable to calculate the extended position without first pulling the leading edge 24 into the at least one flat length. For example, the pressure sensor 38 may be configured to calculate the slightest pressure (e.g., any determinable nonzero pressure) applied to the catch 26, or an optical sensor may simply detect when the leading edge 24 contacts the catch 26, and the position of at least one of the spread carriages 16, 18 may be recorded at this point; however, failing to pull the leading edge 24 into at least one flat length may result in a loss of accuracy, as the amount of the leading edge held slack is not readily determinable and may vary across textiles with differently sized leading edges.

Once the catch 26 has intercepted the leading edge 24 and the position of at least one of the spread carriages 16, 18 is recorded, the catch 26 may be retracted to permit the continued motion of the leading edge until at least one of spread carriages 16, 18 reaches the extended position and leading edge 24 is substantially flat, as shown in FIG. 4. Catch 26 may be configured to retract from the path of the leading edge upon, for example, detecting pressure exceeding the predetermined threshold. The pressure threshold of pressure sensor 38 may be configured to diminish according to the location of the spread carriages 16, 18. It will be understood that applying pressure to a textile 20 when the spread carriages 16, 18 are late in the spread sequence will stretch, and thus damage, textile 20 more than applying the same pressure to textile 20 early in the spread sequence. Thus, reducing the required pressure as the spread carriages 16, 18 travel toward the extended position avoids damaging the textile 20 when it is intercepted by catch 26. The below Table 1 provides an example set of pressure threshold values (in PSI) as the spread carriages 16, 18 move from the first position to the second position (given in mm from the first position):

TABLE 1

| Servo Position (mm) | Catch Pressure (PSI) |
|---|---|
| 0 | 40 |
| 50 | 39 |
| 100 | 39 |
| 150 | 38 |
| 200 | 37 |
| 250 | 37 |
| 300 | 36 |
| 350 | 35 |
| 400 | 34 |
| 450 | 34 |
| 500 | 33 |
| 550 | 32 |
| 600 | 32 |
| 650 | 31 |
| 700 | 30 |
| 750 | 30 |
| 800 | 29 |
| 850 | 28 |
| 900 | 27 |
| 950 | 27 |
| 1000 | 26 |
| 1050 | 25 |
| 1100 | 25 |
| 1150 | 24 |
| 1200 | 23 |
| 1250 | 23 |
| 1300 | 22 |
| 1350 | 21 |
| 1400 | 20 |
| 1450 | 20 |
| 1500 | 19 |
| 1550 | 18 |
| 1600 | 18 |
| 1650 | 17 |
| 1700 | 16 |
| 1750 | 16 |
| 1800 | 15 |
| 1850 | 14 |
| 1900 | 13 |
| 1950 | 13 |
| 2000 | 12 |
| 2050 | 11 |
| 2100 | 11 |
| 2150 | 10 |
| 2200 | 9 |
| 2250 | 9 |
| 2300 | 8 |
| 2350 | 7 |
| 2400 | 6 |
| 2450 | 6 |
| 2500 | 5 |
| 2550 | 4 |
| 2600 | 4 |
| 2650 | 3 |
| 2700 | 2 |
| 2750 | 2 |
| 2800 | 1 |
| 2850 | 0 |

As may be seen in example shown in the above Table 1, when the spread carriages 16, 18 are in the first position (i.e., at 0 mm), the pressure threshold of the catch is set to 40 PSI. As the spread carriages 16, 18 move outward, the pressure threshold drops on linear scale. At the maximum position, the spread carriages 16, 18 may, for example, be roughly 112" apart, or 56" from the initial position, the pressure threshold having dropped to 0 psi. In alternate embodiments, the pressure threshold may drop non-linearly. Furthermore, it should be understood that the pressure thresholds are merely provided as examples will vary in accordance with variables such as the height between the catch and the spread carriages, the location of the first position, etc. By varying the pressure threshold in this way (or in similar ways), textiles of different sizes, makes, and materials, or textiles that have been laundered different numbers of cycles or have varying amounts of water retention, may be pulled flat without improperly stretching and thus damaging the textile.

Once the leading edge 24 of textile 20 is held substantially flat, leading edge 24 will extend, for example, along plane y (assuming the spread carriages 16, 18 have not also traveled upwards or downwards with respect to the textile spreader apparatus), as shown in FIG. 4. (It should be understood that the location of plane y with respect to the device 12 will be dependent on the path traveled spread carriages 16, 18.)

As mentioned above, the location of the extended position may be determined through a calculation based on the location of the catch 26 and at least one of the spread carriages 16, 18, once the catch 26 has intercepted the leading edge 24. One such calculation is depicted in connection with FIG. 5, which shows the angular relationships between a textile 20 having a leading edge 24 with a partial-length L. Partial-length L, here, refers to the portion of leading edge 24 spanning the gap between the catch 26 at least one of the spread carriages 16, 18.

Figure 5:
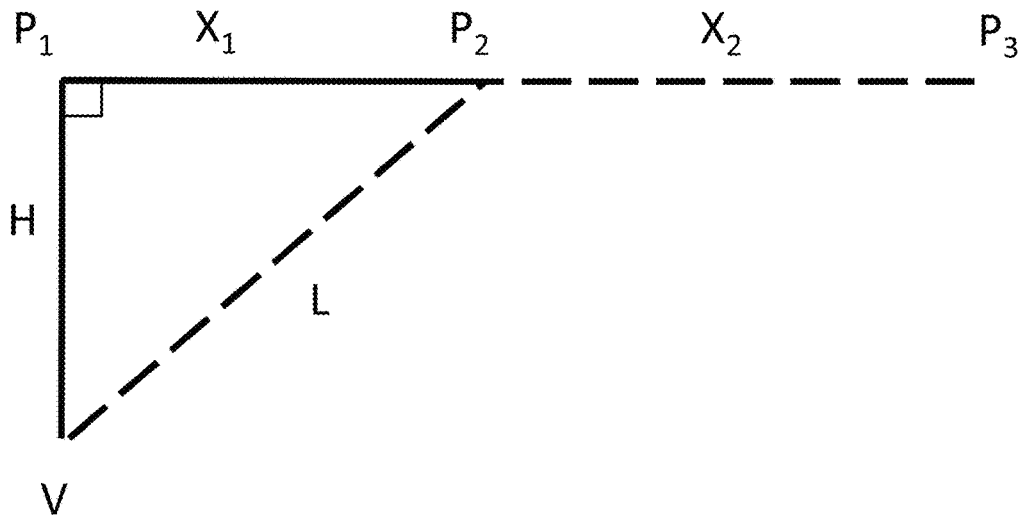
FIG. 5 is a diagram of angular relationships between a textile and a spread carriage, according to an embodiment.

As shown in FIG. 5, in an embodiment, spread carriages 16, 18 travel along plane y from the initial position $P_1$ to the intermediate position $P_2$, which is the location of the spread carriages 16, 18 once the leading edge 24 has been intercepted by the catch 26. The distance between the initial position $P_1$ and the intermediate position $P_2$ is marked as first distance $X_1$. First distance $X_1$ will depend, in part, on the distance the initial position $P_1$ and the catch 26, labeled in FIG. 5 as height H, and the partial-length L of the leading edge 24.

Once the leading edge 24 is intercepted by catch 26, distance $X_1$ is measured. The values of first distance $X_1$ and second distance $X_2$ will be a function of each other and of the textile's 20 partial-length L. Because a portion of leading edge 24 of textile 20 is grasped within the clamps, distances $X_1$ and $X_2$ and partial-length L are measured or calculated with respect to the portion of leading edge 24 not grasped within clamps—indeed, this is the only portion of leading edge 24 that may be measured and pulled flat. Note that although only one $X_1$ is shown, both spread carriages 16, 18 have moved away from the initial position in substantially opposing directions. In this embodiment, spread carriages 16, 18 move away from the initial position in a similar manner, and thus, since the distance from initial position $X_1$ is substantially the same for both spread carriages 16, 18, it is only necessary to calculate the distance $X_1$ for both spread carriages 16, 18. In alternate embodiments, spread carriages 16, 18 may move outward from the initial position at differing or inconsistent rates, thus requiring the position of each spread carriage to be measured separately.

In one embodiment, the distance $X_1$ may be measured by the servos of spread carriages 16, 18. The position of the servos of spread carriages 16, 18 may be, for example, relayed on a regular basis to controller 14. It should be appreciated, however, that distance $X_1$ may be measured in any other suitable for way. For example, in an alternate embodiment, the amount of time that has elapsed between the actuation of spread carriages 16, 18 and the interception of the leading edge by catch 24 may be determined. If the velocity of the spread carriages 16, 18 is known, multiplying the elapsed time by the known velocity will yield the distance $X_1$.

First distance $X_1$ is thus known and may be used in conjunction with known height H. Similarly, when the spread carriages 16, 18 are at intermediate position $P_2$, the height H of the vertex V is also known with respect to the initial position, having either been determined a priori or measured, for example, via a sensor or a mechanical measuring assembly, if the location of the catch changes.

As height H and the first distance $X_1$ are known, partial-length L (which spans the gap between the catch 26 and one of spread carriages 16, 18) may be calculated by setting the initial position $P_1$, intermediate position $P_2$, and location of catch as vertices of triangle. In this way, partial length L of the leading edge 24, spanning the gap between the catch 26 and one of the spread carriages 16, 18, forms the hypotenuse of the triangle, the distance $X_1$ forms a first leg of the triangle, and the distance H from the initial position to the catch 26 forms the second leg of the triangle. Thus, because the intersection of the distance H and $X_1$ form a right angle, we may determine the partial length L using the Pythagorean Theorem, as shown below.

$$L=\sqrt{x_1^2+H^2}$$

As height H is theoretically equal to zero when the textile 20 is flat, the second distance $X_2$—being the remaining distance that spread carriages 16, 18 must travel reach extended position $P_2$—can be calculated after L is calculated, as shown below.

$$x_2=L-x_1$$

The above equations may be simplified such that the second distance $X_2$ can be calculated with only the known first distance $X_1$ and the height H of the vertex V, as shown below.

$$x_2=\sqrt{x_1^2+H^2}-x_1$$

Figure 6:
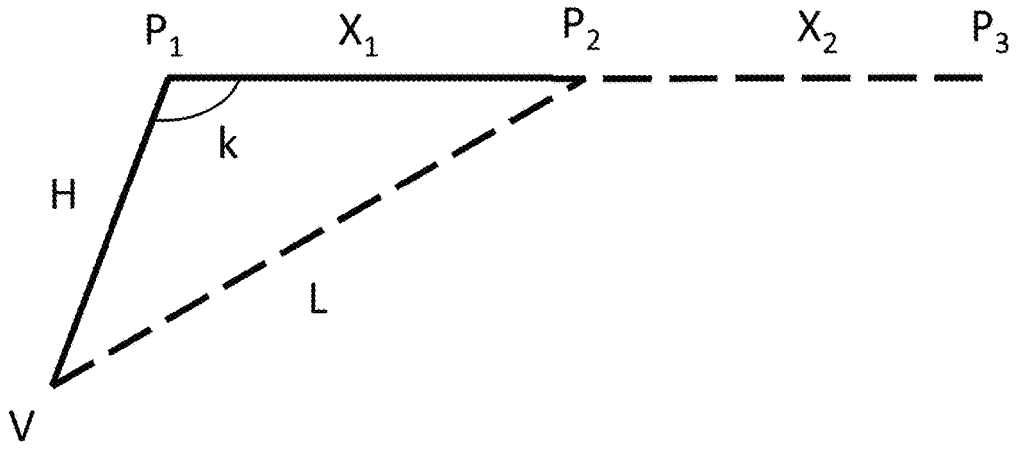
FIG. 6 is a diagram of angular relationship between a textile and a spread carriage, according to another embodiment.

Turning now to FIG. 6, there is shown an alternative embodiment wherein the height H of the vertex V does not extend exactly perpendicular to plane y of the textile spreader apparatus 12. (And thus, the intersection of the distance H and $X_1$ do not form a right angle) This may occur, for example, if the initial position of either of spread carriages 16, 18, is not considered to be directly above catch 26. The angular relationship shown in FIG. 6 is just one alternative embodiment.

Angle k may be known a priori. For example, when the textile spreader apparatus 12 is manufactured, assembled, or otherwise prepared for use, the angle k between plane y and the height H of the vertex V is measurable. Using known angle k and height H, and measured position $P_2$, partial-length L can be calculated using the formula shown below.

$$L=\sqrt{X_1^2+H^2-2(X_1)(H)\cos(k)}$$

As height H is theoretically equal to zero when the textile 20 is flat, the second distance $X_2$ can be calculated after edge length L is calculated, as shown below.

$$x_2=L-x_1$$

Again, the above equations may be simplified such that the second distance $X_2$ can be calculated with only the known first distance $X_1$ and the height H of the vertex V, as shown below.

$$x_2=\sqrt{X_1^2H^2-2(X_1)(H)\cos(k)}-x_1$$

Referring back to FIG. 6, although angle k is the known angle, any included angle in the triangle can be used to calculate the second distance $X_2$. The edge of length L is first calculated using, for example, the Law of Cosines. Then, the first distance $X_1$ is subtracted from the edge length L to calculate the second distance $X_2$.

It should be understood that the above calculations represent only one of a multitude of ways of calculating the location of the extended position $P_3$ using the known locations of the catch 26 and at least one of the spread carriages 16, 18. Indeed, any number of different triangles may be formed, once these locations are known, to determine the partial-length L, and, consequently, the location of the extended position. Further, any number of factors, such as the initial positions of each of the spread carriages 16, 18, the rate at which the spread carriages travel with respect to each other, the path that the spread carriages take, etc., may all be varied in alternate embodiments, these variations thus affecting the equations by which the partial length L and the location of the extended position are calculated.

In another embodiment, the textile spreader apparatus 12 utilizes a lookup table to determine the second distance $X_2$. The lookup table comprises the calculated second distance $X_2$, or the extended position, for different combinations of values for height H, first distance $X_1$, angle k, and/or edge length L.

For example, the length of the leading edge may be determined according to a look-up table based only upon the location of the catch and of one of the spread carriages 16, 18, once the catch has intercepted the leading edge. Indeed, if the location of the catch does not change, or is otherwise known before initiating the spread sequence, the location of the extended position may be determined based on the location of one of the spread carriages alone, because the location of the catch 26, as well as the height H and the location of the initial position, remains constant.

The look-up table, may, for example, include a set of possible locations of one of the spread carriages 16, 18, each possible location being respectively associated with an extended position. Once the position of one of the spread carriages 16, 18, is known, this value is compared to the nearest possible location stored in the look-up table, and the associated respective extended position is retrieved. The accuracy of the look-up table is determined by the number of possible values and corresponding extended positions stored in the look-up table. However, steps may be taken to mitigate some level of granularity inherent to look-up tables. For example, if the measured location of one of the spread carriages 16, 18, is between two possible locations stored in the look-up table, the location of the extended position may be estimated by interpolating between the two stored extended position values corresponding to the two possible locations the measured location rests between. The position of one or more of the spread carriages 16, 18 may be input as a distance from a reference point, such as the initial position; however, in alternate embodiments, the position may be an arbitrary notation corresponding to the point along the track or otherwise located in space.

If the location of the catch 26 is not constant, the look up table may be expanded to include two inputs: (1) the location of the catch and (2) the location of at least one of the spread carriages 16, 18, in order to account for the varying height H. In another embodiment, the positions of both spread carriages 16, 18 may be inputs to the look-up table. Inputting the positions of both spread carriages 16, 18 may also be particularly necessary if the respective positions of both spread carriages 16, 18 is not consistent or predictable given the location of one of the spread carriages 16, 18 (e.g., the individual spread carriages 16, 18 move at unpredictable rates).

Figure 7:
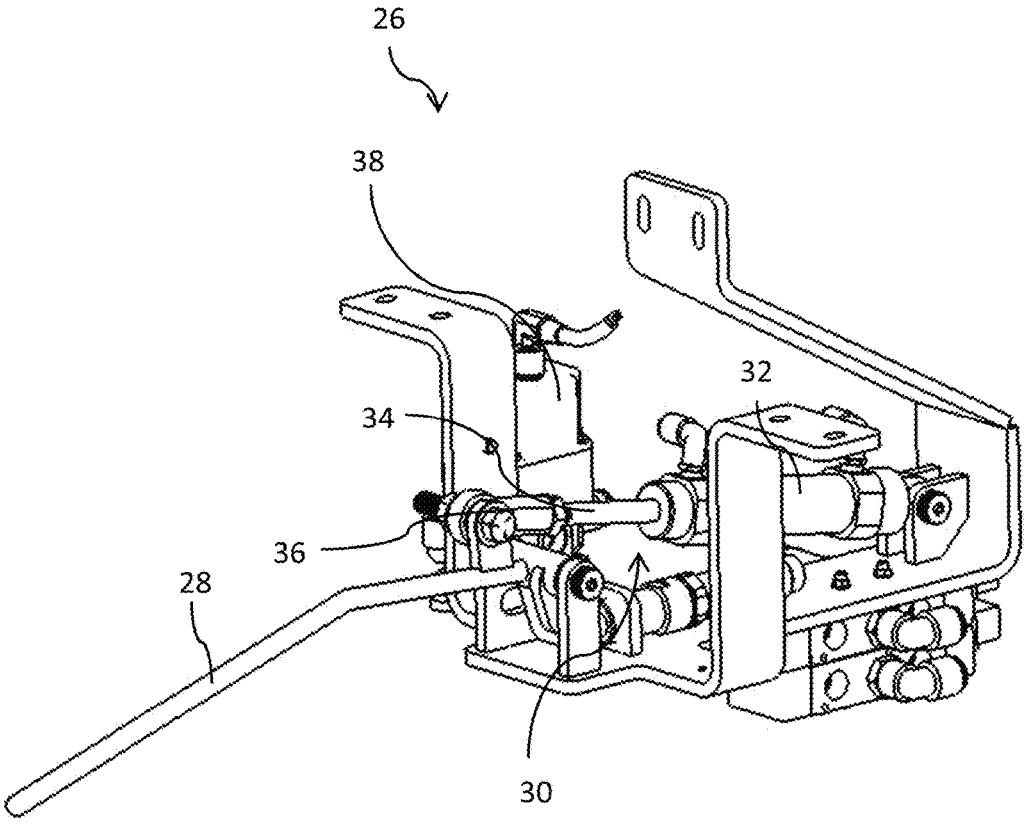
FIG. 7 is a front perspective view of a catch assembly in the lowered position according to an embodiment.
Figure 8:
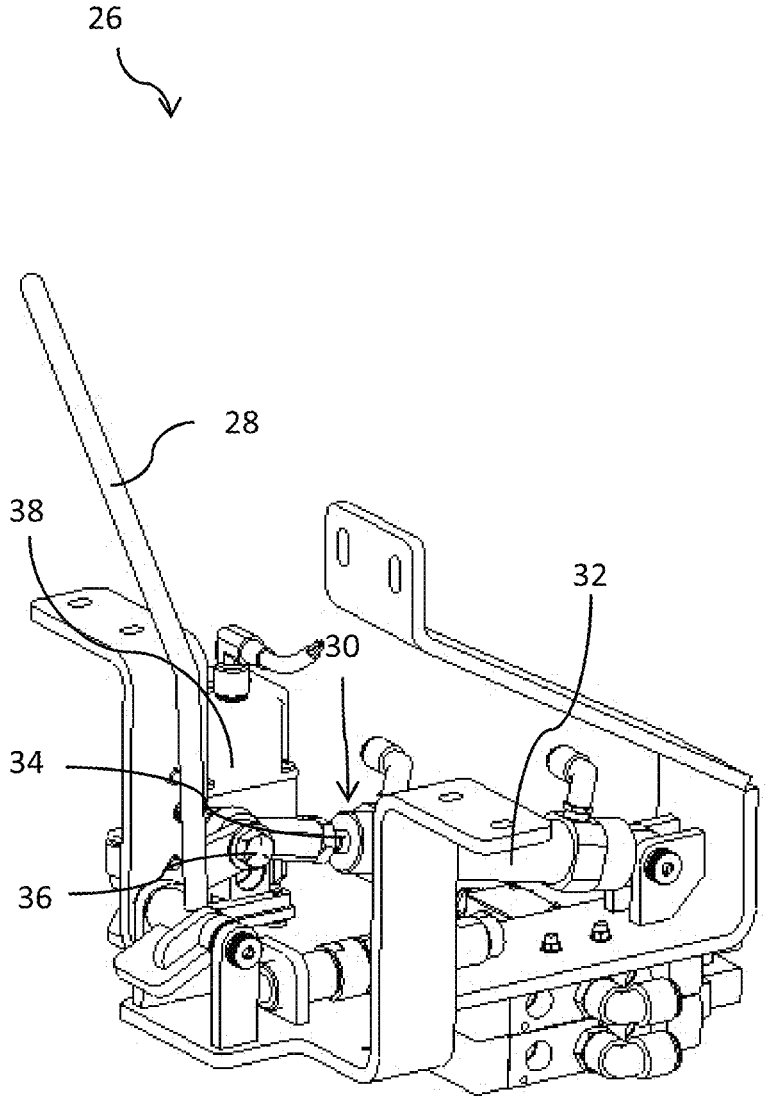
FIG. 8 is a front perspective view of a catch assembly in the retracted position according to an embodiment.

Referring now to FIGS. 7-8, there is shown an embodiment of a catch 26 in perspective views. Catch 26 may be either fixed or removably attached to the textile spreader apparatus 12. As shown in FIG. 7, in the depicted embodiment, catch 26 may comprise a pivotable wand 28, which may pivot from a lowered position to a retracted position. The pivotable wand 28 may be moved from the lowered position to the retracted position via a pneumatic arrangement 30 comprising, for example, a pneumatic cylinder 32 and rod 34. In the embodiment shown, actuation of the pneumatic arrangement 30 drives rod 34 outward, causing pivotable wand 28 to pivot downward, about pivot 36, to the lowered position. Conversely, actuation of the pneumatic arrangement to draw the rod 34 within cylinder 32 pulls pivotable wand 28 up into the retracted position (as shown, for example, in FIG. 8). While pivotable wand 28 is depicted as an elongated, bent rod, one of ordinary skill in the art will recognize, in conjunction with reviewing this disclosure, that pivotable wand 28 may take any number of forms, as long as the pivotable wand 28 is shaped and positioned to intercept leading edge 24 as required by the various embodiments described in this disclosure. Furthermore, in alternate embodiments, pivotable wand may be pivoted between the lowered and retracted positions by a mechanism other than pneumatic arrangement 30. For example, in alternate embodiments, pneumatic arrangement 30 may be replaced by a servo arrangement similarly configured to pivot pivotable wand 28.

As shown in FIGS. 7-8, and as described above, catch 26 may further include sensor 38, depicted as a backpressure sensor, configured to detect when catch 26 has intercepted leading edge 24 and leading edge 24. In the embodiment shown, sensor 38 may detect when some pressure is applied to pivotable wand 28, causing backpressure to occur within cylinder 32 as a result of the motion of rod 34. When the backpressure exceeds some threshold value, the position of at least one of the spread carriages 16, 18 is recorded and the pivotable wand 28 is retracted. As described elsewhere, sensor may take other forms in other embodiments, such as a proximity sensor or optical sensor.

Again, the pressure threshold for which the pivotable wand 28 retracts may diminish as the spread carriages 16, 18 move outward. The pressure threshold may be managed, for example, by the controller 14. This may be accomplished by regulating the flow of air into pressure sensor 38 according to the location of the spread carriages 16, 18, thus adjusting the sensed back pressure. As the spread carriages move in substantially opposing directions, the pressure may be reduced based on the detected location of the spread carriages 16, 18. Note that if the spread carriages were to stop at any time, the change in back pressure would also hold steady on the given value for the position of spread carriages 16, 18.

Turning now to FIG. 8, there is shown a front perspective view of catch 26 in the retracted position according to an embodiment. In the lowered position, the pivotable wand 28 is held away from spreader/feeder 10 such that the pivotable wand 28 is in the path of leading edge 24, shown in FIGS. 3 and 8. Once the sensor 38 is triggered the pivotable wand 28 rotates from the lowered position toward spreader/feeder 10, until the wand 28 reaches the retracted position.

After intercepted leading edge 24, and as the leading edge 24 is pulled by the spread carriages 16, 18 toward plane y, the wand 28 rotates from the extended position to the retracted position. Thus, in the period when the pivotable wand 28 is in the lowered position, the spread carriages 16, 18 are in the initial position or are moving toward or in the intermediate position, and when the wand 28 is in the retracted position, the spread carriages 16, 18 have progressed beyond the intermediate position and are in or are moving toward the extended position.

While embodiments of the present invention has been particularly shown and described with reference to certain exemplary embodiments, it will be understood by one skilled in the art that various changes in detail may be effected therein without departing from the spirit and scope of the invention as defined by claims that can be supported by the written description and drawings. Further, where exemplary embodiments are described with reference to a certain number of elements it will be understood that the exemplary embodiments can be practiced utilizing either less than or more than the certain number of elements.

What is claimed is:

1. A textile spreader apparatus, comprising:

a first spread carriage and a second spread carriage, each configured to respectively receive opposing corners of a leading edge of a textile and to respectively convey the opposing corners in substantially opposing directions toward an extended position, such that the leading edge of the textile travels along a predetermined path;

a catch arranged in the predetermined path of the leading edge, such that the catch intercepts the leading edge; and a sensor configured to detect when the catch intercepts the leading edge, wherein the catch is configured to retract from the path of the leading edge upon the sensor detecting a pressure, exceeding a threshold, applied to the leading edge, wherein the threshold is reduced as the first spread carriage and the second spread carriage convey the opposing corners toward the extended position.

2. The textile spreader apparatus of claim 1, further comprising:

a controller configured to determine an extended position based on the position of at least one of the first spread carriage or the second spread carriage after the catch intercepts the leading edge, wherein the first and second spread carriages, when respectively positioned at the extended position, are spaced apart substantially the length of the leading edge.

3. The apparatus of claim 2, wherein the first spread carriage and second spread carriage are configured to respectively convey the opposing corners to the extended position such that the leading is edge is drawn substantially flat.

4. The apparatus claim 2, wherein the controller is configured to determine the extended position according to a calculation.

5. The apparatus of claim 4, wherein the calculation determines the length of a portion of the leading edge by setting the respective positions of the catch and one of the first spread carriage or second spread carriage as vertices of a triangle, the portion of the leading edge forming a leg of the triangle.

6. The apparatus of claim 2, wherein the controller is configured to determine the extended position according to a look up table.

7. A textile spreader apparatus, comprising:

a first spread carriage and a second spread carriage, each configured to respectively receive opposing corners of a leading edge of a textile and to respectively convey the opposing corners in substantially opposing directions, such that the leading edge of the textile travels along a predetermined path;

a catch arranged in the predetermined path of the leading edge such that the catch intercepts the leading edge;

a sensor configured to detect when the catch intercepts the leading edge; and a controller configured to determine an extended position based on the position of at least one of the first spread carriage or the second spread carriage after the catch intercepts the leading edge, wherein the first and second spread carriages, when respectively positioned at the extended position, are spaced apart substantially the length of the leading edge.

8. The apparatus of claim 7, wherein the catch is configured to retract from the path of the leading edge.

9. The apparatus of claim 8, wherein the catch is configured to retract from the path of the leading edge upon the sensor detecting a pressure exceeding a threshold, wherein the threshold is reduced as the first spread carriage and the second spread carriage convey the opposing corners toward the extended position.

10. The apparatus of claim 7, wherein the first spread carriage and second spread carriage are configured to respectively convey the opposing corners to the extended position such that the leading is edge is drawn substantially flat.

11. The apparatus of claim 7, wherein the controller is configured to determine the extended position according to a calculation.

12. The apparatus of claim 11, wherein the calculation determining a length of a portion of the leading edge by setting the respective positions of the catch and one of the first spread carriage or second spread carriage as vertices of a triangle, the portion of the leading edge forming a leg of the triangle.

13. The apparatus of claim 7, wherein the controller is configured to determine the extended position according to a look up table.

14. A method for determining the length of a leading edge of a textile, comprising the steps of:

providing a textile spreader apparatus comprising a first spread carriage and a second spread carriage, each configured to move between an initial position and an extended position;

grasping a pair of opposing corners of a leading edge of a textile with the first and second spread carriages, wherein each of the first and second spread carriages respectively grasps one of the opposing corners such that a portion of a leading edge of the textile is held slack about a catch;

conveying, with the first spread carriage and second spread carriage, the opposing corners in substantially opposing directions such that the leading edge travels along a predetermined path such that the catch, arranged in the predetermined path, intercepts the leading edge;

detecting, with a sensor, when the catch intercepts the leading edge; and determining an extended position based on the position of at least one of the first spread carriage or the second spread carriage after the catch intercepts the leading edge, wherein the first and second spread carriages, when respectively positioned at the extended position, are spaced apart substantially the length of the leading edge.

15. The method of claim 14, further comprising the step of retracting the catch from the path of the leading edge.

16. The method of claim 15, wherein the step of retracting the catch comprises: retracting the catch from the path of the leading edge upon the sensor detecting a pressure exceeding a threshold, wherein the threshold is reduced as the first spread carriage and the second spread carriage convey the opposing corners toward the extended position.

17. The method of claim 14, further comprising the step of conveying the opposing corners to the extended position such that the leading is edge is drawn substantially flat.

18. The apparatus claim 14, the extended position is determined according to a calculation.

19. The apparatus of claim 18, wherein the calculation determines the length of a portion of the leading edge by setting the respective positions of the catch and one of the first spread carriage or second spread carriage as vertices of a triangle, the portion of the leading edge forming a leg of the triangle.

20. The apparatus of claim 14, wherein the extended position is determined according to a look up table.

* * * * *